US006530156B1

(12) United States Patent
Matsuyama

(10) Patent No.: US 6,530,156 B1
(45) Date of Patent: Mar. 11, 2003

(54) TARGET-LENS-SHAPE MEASURING DEVICE WITH EYEGLASS-LENS PROCESSING APPARATUS HAVING THE SAME

(75) Inventor: Yoshinori Matsuyama, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/631,962

(22) Filed: Aug. 3, 2000

(30) Foreign Application Priority Data

Aug. 3, 1999 (JP) ..... 11-220089

(51) Int. Cl.[7] ..... G01B 5/20

(52) U.S. Cl. ..... 33/507; 33/200; 33/559; 33/572; 33/556

(58) Field of Search ..... 33/507, 28, 200, 33/559, 572, 556, 553, 561

(56) References Cited

U.S. PATENT DOCUMENTS

| | | | | |
|---|---|---|---|---|
| 5,121,548 A | * | 6/1992 | Daboudet et al. | 33/507 |
| 5,138,770 A | | 8/1992 | Matsuyama | 33/28 |
| 5,228,242 A | | 7/1993 | Matsuyama | 51/165.74 |
| 5,333,412 A | | 8/1994 | Matsuyama | 51/165.71 |
| 5,347,762 A | | 9/1994 | Shibata et al. | 451/15 |
| RE35,898 E | | 9/1998 | Shibata et al. | 451/5 |
| 5,881,467 A | * | 3/1999 | Clara et al. | 33/200 |
| 5,959,199 A | | 9/1999 | Suzuki et al. | 73/104 |
| 6,006,592 A | | 12/1999 | Suzuki et al. | 73/104 |
| 6,163,967 A | * | 12/2000 | Suzuki et al. | 33/507 |
| 6,170,321 B1 | * | 1/2001 | Suzuki et al. | 33/507 |

FOREIGN PATENT DOCUMENTS

| | | | | |
|---|---|---|---|---|
| EP | 0 190 450 A1 | | 8/1986 | G01B/7/28 |
| EP | 0 868 969 A2 | | 10/1998 | B24B/9/14 |
| JP | 61-267732 | | 11/1986 | G02C/13/00 |
| JP | 3-11526 | | 1/1991 | H01J/23/10 |
| JP | 3-20603 | | 1/1991 | G01B/5/06 |
| JP | 03020603 | * | 1/1991 | 33/507 |
| JP | 6-194153 | | 7/1994 | G01B/21/20 |
| JP | 10-217086 | | 8/1998 | B24B/9/14 |
| JP | 10-277901 | | 10/1998 | B24B/9/14 |
| JP | 2907974 | | 4/1999 | B24B/9/14 |
| JP | 2918657 | | 4/1999 | B24B/9/14 |
| JP | 2925685 | | 5/1999 | B24B/9/14 |

OTHER PUBLICATIONS

Patent Abstracts of Japan, 06194153, Jul. 15, 1994.

* cited by examiner

*Primary Examiner*—Diego Gutierrez
*Assistant Examiner*—Travis Reis
(74) *Attorney, Agent, or Firm*—Sughrue Mion, PLLC

(57) ABSTRACT

A target lens shape measuring device for measuring a target lens shape of an eyeglass lens has a measuring section including: a template feeler contactable with a periphery of a template; a first supporting base to which the template feeler is attached; a first motor and a link mechanism that move the template feeler and the first supporting base between a measuring position and a retracted position, wherein the link mechanism located between the measuring position and the retracted position is engaged with the first supporting base, and the link mechanism located at the measuring position is disengaged with the first supporting base; a second motor that moves the template feeler and the first supporting base in a radius vector direction of the template; and a first encoder that detect an amount of movement of the template feeler and the first supporting base in the radius vector direction of the template. A calculating section obtains radius vector information of the template based on the amount of movement detected by the first encoder.

4 Claims, 13 Drawing Sheets

TARGET-LENS-SHAPE MEASURING DEVICE WITH EYEGLASS-LENS PROCESSING APPARATUS HAVING THE SAME

BACKGROUND OF THE INVENTION

The present invention relates to a target-lens-shape measuring device for measuring a target lens shape of a template (including a dummy lens) obtained by tracing the shape of a lens frame of an eyeglass frame, and an eyeglass-lens processing apparatus having the same.

As target-lens-shape measuring devices, those disclosed in, for example, U.S. Pat. No. 5,138,770, European Patent 0868969 (US 09/050,977) and the like are known. In this type of device, after an eyeglass frame is held by a holding means, a feeler (frame-measuring feeler) is inserted into and moved along a frame groove, so that the amount of movement of the feeler is detected to measure the target lens shape of the lens frame. In addition, this device is so arranged to be able to measure a template by using (using in common) a detecting mechanism for detecting the amount of movement of the feeler. In the measurement of the template, a measuring pin (template feeler) which is to be brought into contact with an outer periphery of the template is attached to a measuring mechanism section so as to effect the measurement. After completion of the template measurement, the measuring pin is removed from the measuring mechanism section so that it will not hinder the measurement of the eyeglass frame.

With the device as described above, however, the operator must manually attach and detach the measuring pin on each occasion of the template measurement, so that the operation is time-consuming and troublesome. In addition, since the measuring pin is unnecessary other than during the template measurement, the measuring pin must be removed and stored separately. However, the storage is troublesome, and the measuring pin may be lost.

SUMMARY OF THE INVENTION

In view of the above-described problems, an object of the invention is to provide a target-lens-shape measuring device which eliminates the troublesomeness of attaching and detaching the measuring pin and makes it possible to effect template measurement speedily. Another object of the present invention is to provide an eyeglass-lens processing apparatus having such target-lent-shape measuring device.

To overcome the above-described problems, the invention provides the following construction.

A target lens shape measuring device for measuring a target lens shape of an eyeglass lens, comprising:

a template feeler contactable with a periphery of a template;

first moving means for moving the template feeler in a radius vector direction of the template along a guide;

template measuring means for detecting movement of the template feeler, and obtaining radius vector information of the template based on a result of detection thereof;

second moving means for moving the template feeler between a measuring position and a retracted position, the second moving means including a driving power source and a transmitting mechanism for transmitting power of the driving power source, wherein the transmitting mechanism moves the template feeler from one of the measuring position and the retracted position to the other of the measuring position and the retracted position in a state in which the transmitting mechanism is engaged with a member of the first moving means, and the transmitting mechanism is disengaged from the member of the first moving means upon the template feeler reaches the measuring position; and detecting means for detecting a state in which the template feeler is located at the measuring position.

The device of the present invention, further comprising:

control means for operating the first moving means to measure the template based on a result of detection by the detecting means.

The device of the present invention, further comprising:

fixing means for fixing the template at a predetermined position.

The device of the present invention, further comprising:

an eyeglass frame holding unit including a pair of sliders contactable respectively with an upper end surface and a lower end surface of an eyeglass frame, clamp pins provided on the sliders and adapted to clamp the eyeglass frame, and urging means for urging the sliders toward each other, wherein the template is measured using a space that is defined when the sliders are located away from each other at a predetermined distance against an urging force of the urging means.

The present invention also includes:

fixing means for fixing the template at a predetermined position, wherein the sliders are fixed to have the predetermined distance therebetween when the template is fixed at the position by the fixing means.

The present invention further comprises:

slider detecting means for detecting whether or not the sliders are located to have the predetermined distance therebetween; and mode detecting means for detecting, based on a result of detection by the slider detecting means, a template measuring mode in which the template is to be measured.

The present invention further comprises:

a frame feeler contactable with a frame groove of a lens frame of an eyeglass frame;

third moving means for moving the frame feeler in a radius vector direction of the lens frame; and frame measuring means for detecting movement of the frame feeler, and obtaining radius vector information of the lens frame based on a result of detection thereof;

wherein the first moving means and the third moving means have a common moving mechanism.

In addition, the template measuring means and the frame measuring means have a common movement detecting mechanism.

An eyeglass lens processing apparatus, provided with the target lens shape measuring device of the present invention, for processing the eyeglass lens based on the obtained target lens shape, the apparatus comprising:

lens processing means having a rotatable abrasive wheel and a lens rotating shaft adapted to hold and rotate the lens; and processing control means for controlling the lens processing means based on the obtained target lens shape.

A target lens shape measuring device for measuring a target lens shape of an eyeglass lens, comprising:

a measuring section including:

a template feeler contactable with a periphery of a template;

a first supporting base to which the template feeler is attached;

a first motor and a link mechanism that move the template feeler and the first supporting base between a measuring position and a retracted position, wherein the link mechanism located between the measuring position and the retracted position is engaged with the first supporting base, and the link mechanism located at the measuring position is disengaged with the first supporting base;

a second motor that moves the template feeler and the first supporting base in a radius vector direction of the template; and a first encoder that detect an amount of movement of the template feeler and the first supporting base in the radius vector direction of the template; and a calculating section that obtains radius vector information of the template based on the amount of movement detected by the first encoder.

Also, the measuring section further includes a sensor that detects a state in which the template feeler and the first supporting base are located at the measuring position.

The device also has:

a control section that drives the second motor based on a result of detection by the sensor to measure the template.

The measuring section further includes a guide along which the template feeler and the first supporting base are moved in the radius vector direction of the template.

The measuring section further includes:

a frame feeler contactable with a frame groove of a lens frame of an eyeglass frame;

a second supporting base to which the frame feeler is attached;

a third motor that moves the frame feeler and the second supporting base in a radius vector direction of the lens frame; and a second encoder that detects an amount of movement of the frame feeler and the second supporting base, wherein the calculating section obtains radius vector information of the lens frame based on the amount of movement detected by the second encoder.

The invention also has:

at least one of the template feeler and the first supporting base is movably held on the second supporting base;

the second motor and the third motor are constructed as a common motor; and the first encoder and the second encoder are constructed as a common encoder.

An eyeglass lens processing apparatus, provided with the target lens shape measuring device of the present invention, for processing the eyeglass lens based on the obtained target lens shape, the apparatus comprising:

a lens processing section having a rotatable abrasive wheel and a lens rotating shaft adapted to hold and rotate the lens; and a processing control section that controls the lens processing section based on the obtained target lens shape.

The present disclosure relates to the subject matter contained in Japanese patent application No. Hei. 11-220089 (filed on Aug. 3, 1999), which is expressly incorporated herein by reference in its entirety.

DESCRIPTION OF THE PREFERRED EMBODIMENT

Hereafter, a description will be given of an embodiment of the invention.

(1) Overall Construction

Figure 1:
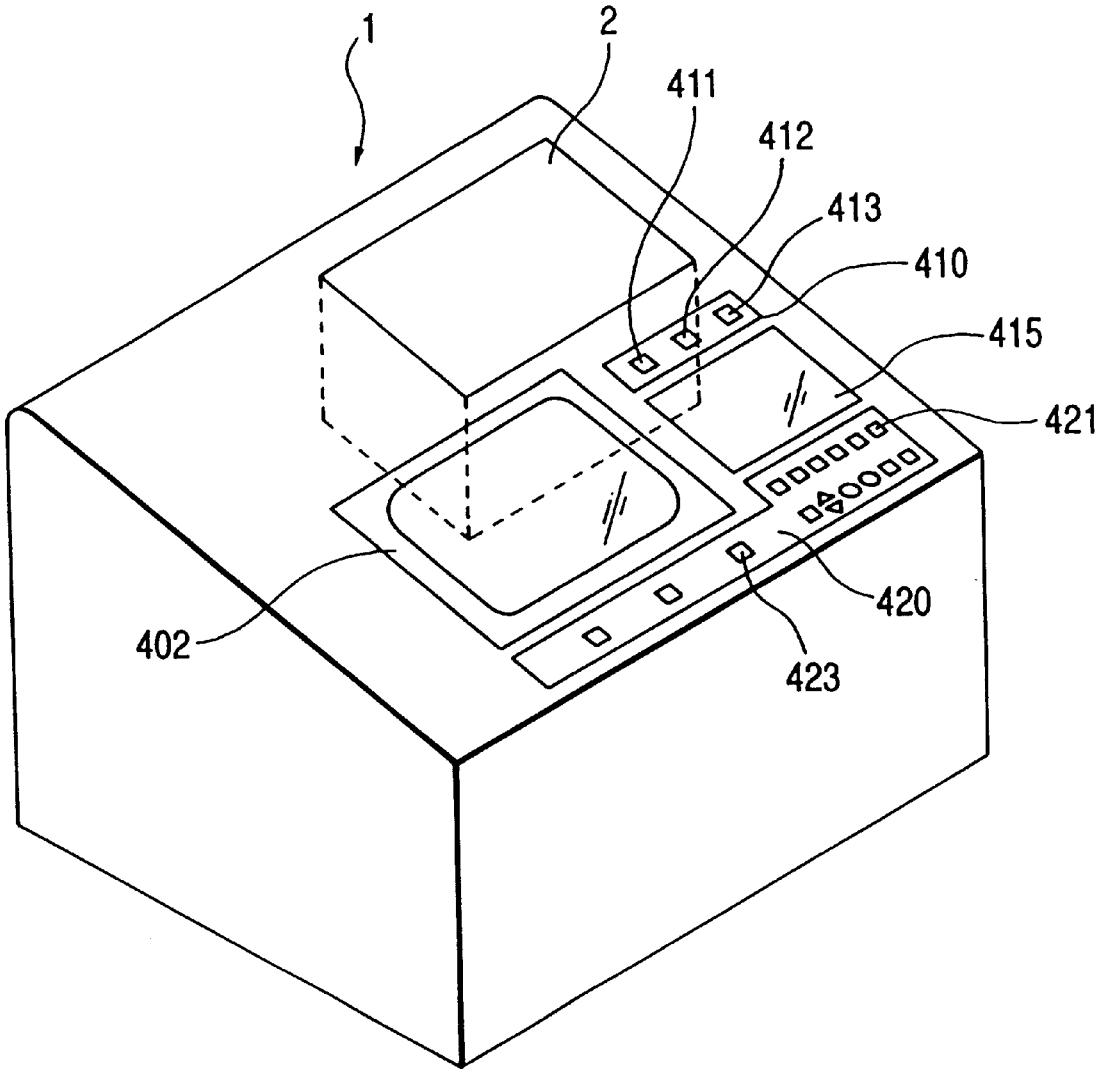
FIG. 1 is a diagram of the external configuration of an eyeglass-lens processing apparatus in accordance with the invention.

FIG. 1 is a diagram illustrating the external configuration of an eyeglass-lens processing apparatus in accordance with the invention. A target-lens-shape measuring device, i.e. an eyeglass-frame-shape measuring device, 2 is incorporated in an upper right-hand rear portion of a main body 1 of the apparatus. The target-lens-shape measuring device 2 is disposed in such a manner as to be inclined toward a front side along the inclination of the upper surface of the casing of the main body 1 so as to facilitate the setting of an eyeglass frame on a frame holding section 200 which will be described later. A switch panel section 410 having switches for operating the target-lens-shape measuring device 2 and a display 415 for displaying processing information and the like are disposed in front of the target-lens-shape measuring device 2. Further, reference numeral 420 denotes a switch panel section having various switches for inputting processing conditions and the like and for giving instructions for processing, and numeral 402 denotes an openable window for a processing chamber.

Figure 2:
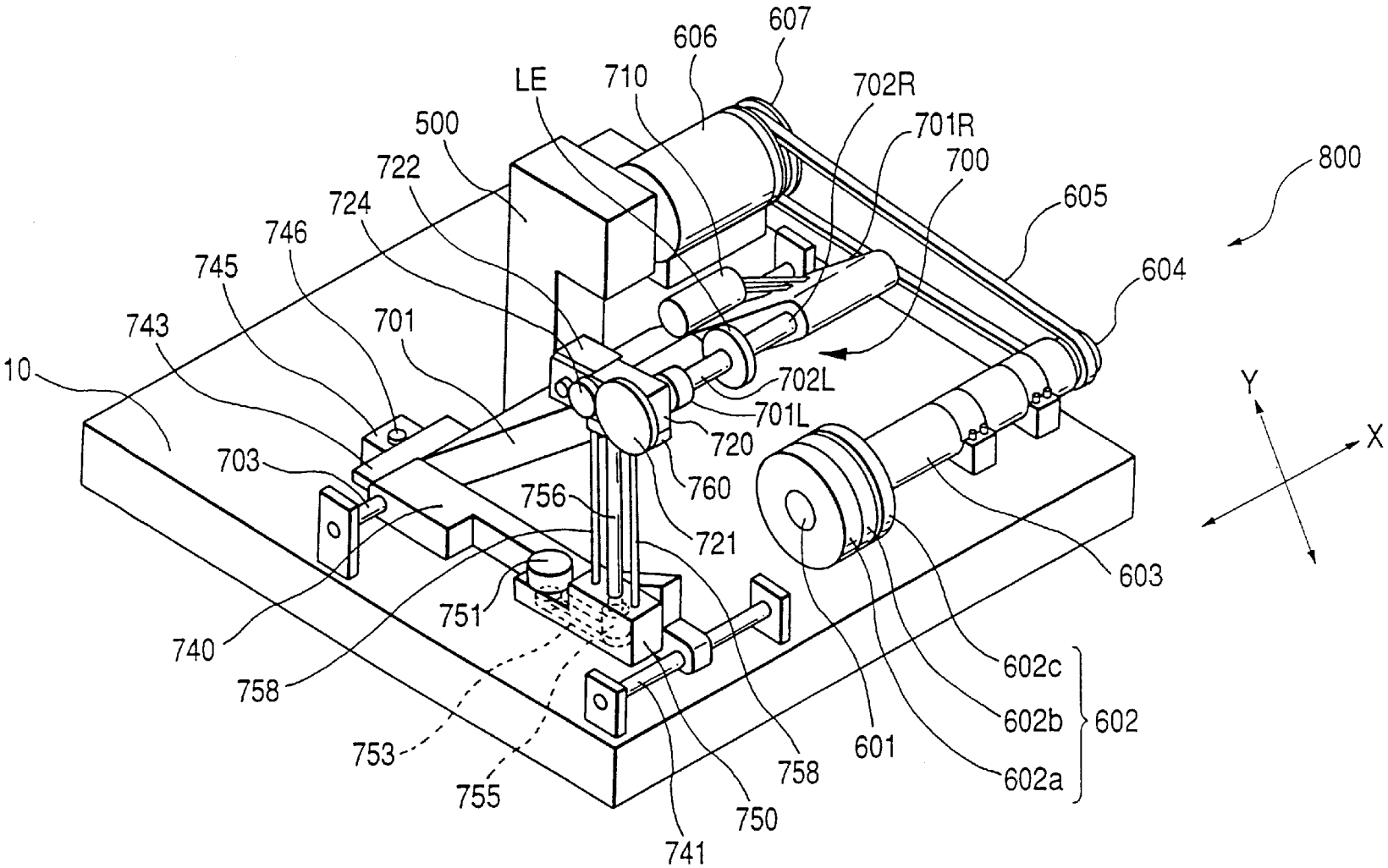
FIG. 2 is a perspective view illustrating the arrangement of a lens processing section disposed in a casing of a main body of the apparatus.

FIG. 2 is a perspective view illustrating the arrangement of a lens processing section disposed in the casing of the main body 1. A carriage unit 700 is mounted on a base 10, and a subject lens LE clamped by a pair of lens chuck shafts 702L and 702R of a carriage 701 is ground by a group of abrasive wheels 602 attached to a rotating shaft 601. The group of abrasive wheels 602 include a rough abrasive wheel 602*a* for glass lenses, a rough abrasive wheel 602*b* for plastic lenses, and a finishing abrasive wheel 602*c* for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606. A lens-shape measuring section 500 is provided in the rear of the carriage 701.

(2) Construction of Various Sections (A) Target-Lens-Shape Measuring Device

A description will be given of the major configuration of the target-lens-shape measuring device 2 by dividing it into the frame holding section, a measuring section, and a template holder.

<Frame Holding Section>

Figure 3:
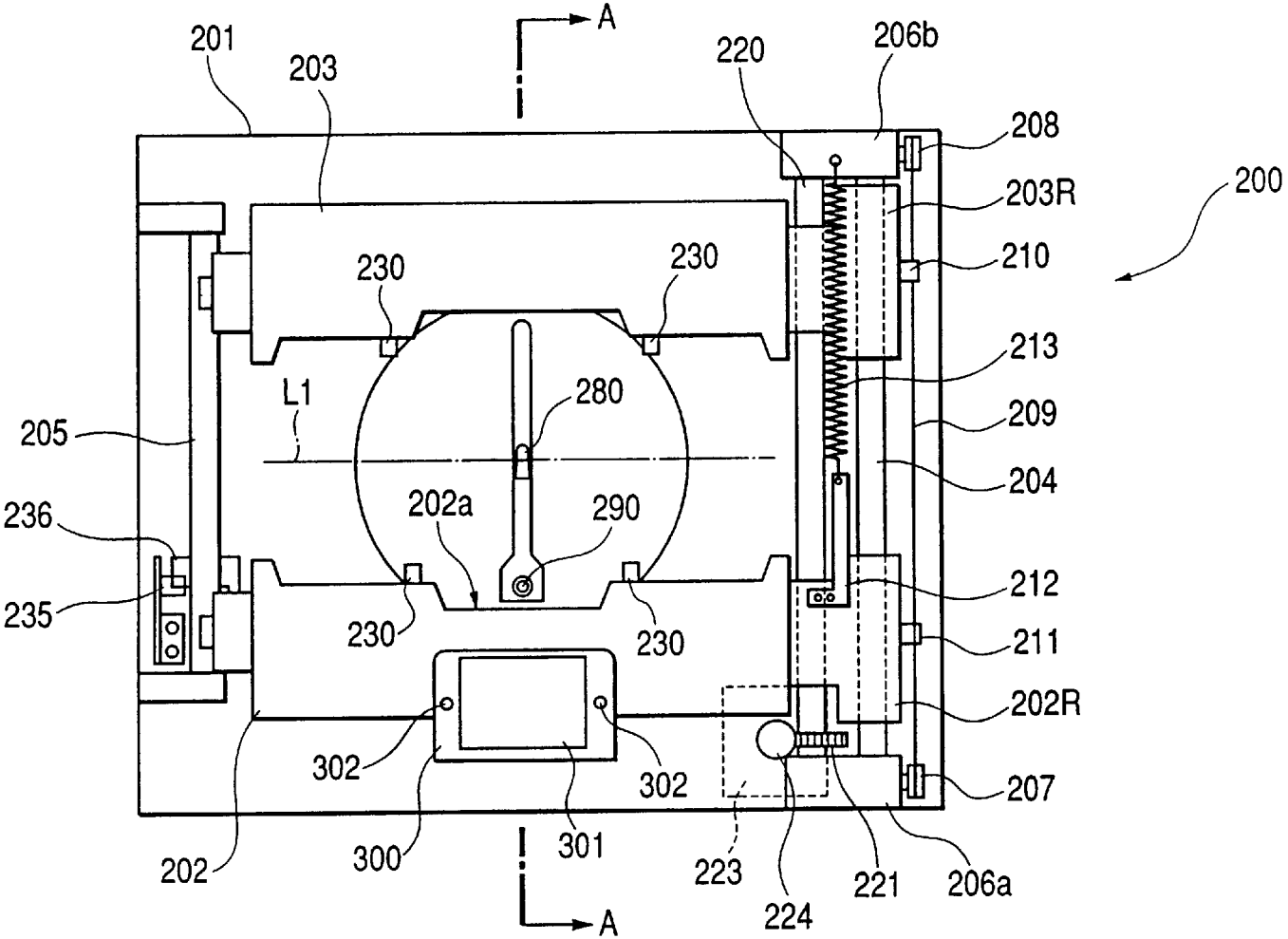
FIG. 3 is a plan view of a frame holding section of an target-lens-shape measuring device.
Figure 4:
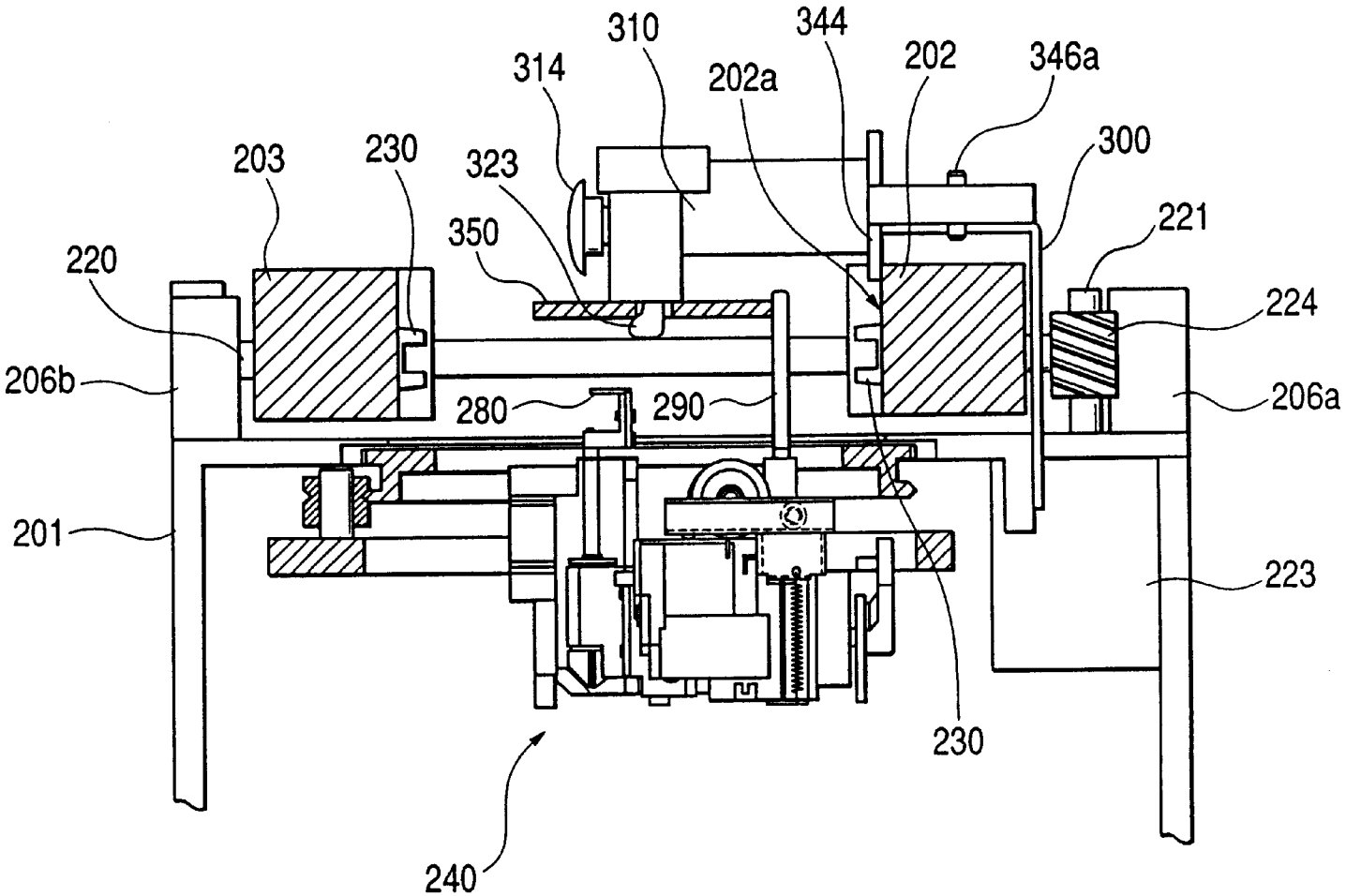
FIG. 4 is a cross-sectional view taken along line A—A in FIG. 3 and illustrating an essential portion.

Referring to FIGS. 3 and 4, a description will be given of the construction of the frame holding section 200. FIG. 3 is a plan view of the frame holding section 200, and FIG. 4 is a cross-sectional view taken along line A—A in FIG. 3 and illustrating an essential portion.

A front slider 202 and a rear slider 203 for holding an eyeglass frame are slidably placed on a pair of guide rails 204 and 205 arranged on the rightand left-hand sides of a holding section base 201. Pulleys 207 and 208 are rotatably attached respectively to a front-side block 206*a* and a rear-side block 206*b* that support the guide rail 204. An endless wire 209 is suspended on the pulleys 207 and 208. An upper side of the wire 209 is secured to a pin 210 attached to a right end member 203R extending from the rear slider 203, while a lower side of the wire 209 is secured to a pin 211 attached to a right end member 202R extending from the front slider 202. Further, a spring 213 is stretched between the rear-side block 206*b* and the right end member 202R using a mounting plate 212, so that the front slider 202 is constantly urged in the direction in which the spring 213 contracts. Owing to this arrangement, the front slider 202 and the rear slider 203 are slid in a symmetrically opposing manner with respect to a reference line L1 at the center therebetween, and are constantly pulled in directions toward that center (reference line L1) by the spring 213. Accordingly, if one of the front slider 202 and the rear slider 203 is slid in the opening direction, a distance therebetween for holding the frame can be secured, and if the front slider 202 and the rear slider 203 are in a free state, the distance therebetween is reduced by the urging force of the spring 213.

The frame is clamped by clamp pins 230 arranged at total four locations, i.e. by clamp pins 230 at right and left two locations of the front slider 202 and clamp pins 230 at right and left locations of the rear slider 203, so as to be held in a reference plane for measurement.

The opening and closing of these clamp pins 230 are effected by driving a clamp motor 223 which is fixed on the reverse side of the holding section base 201. A worm gear 224 attached to a rotating shaft of the motor 223 is in mesh with a wheel gear 221 of a shaft 220 which is rotatably held between the block 206*a* and the block 206*b,* so that the rotation of the motor 223 is transmitted to the shaft 220. The shaft 220 is passed through the right end member 202R and the right end member 203R. Inside the right end member 202R, an unillustrated wire for opening and closing the clamp pins 230 is attached to the shaft 220, and as the wire is pulled by the rotation of the shaft 220, the opening and closing operation of the clamp pins 230 are effected simultaneously. Inside the right end member 203R as well, an unillustrated similar wire is also attached to the shaft 220, and the opening and closing operation of the clamp pins 230 are effected simultaneously by the rotation of the shaft 220. Further, brake pads for securing the opening and closing of the front slider 202 and the rear slider 203 due to the rotation of the shaft 220 are respectively provided inside the right end member 202R and the right end member 203R. As the arrangement of the mechanism for opening and closing the clamp pins 230, it is possible to use the arrangement disclosed in U.S. Pat. No. 5,228,242 commonly assigned to the present assignee, so that reference is had to made thereto for details.

Further, an attaching plate 300 for attaching a template holder 310 (described later), which is used at the time of measuring a template 350 (or a dummy lens), is fixed at the center on the front side of the holding section base 201 as shown in FIG. 4. The attaching plate 300 has an inverse L-shaped cross section, and the template holder 310 is used upon being placed on the upper surface of the attaching plate 300. A magnet 301 is provided in the center of the upper surface of the attaching plate 300, and two holes 302 for positioning the template holder 310 are formed in the attaching plate 300 on the left- and right-hand sides of the magnet 301.

<Measuring Section>

Figure 5:
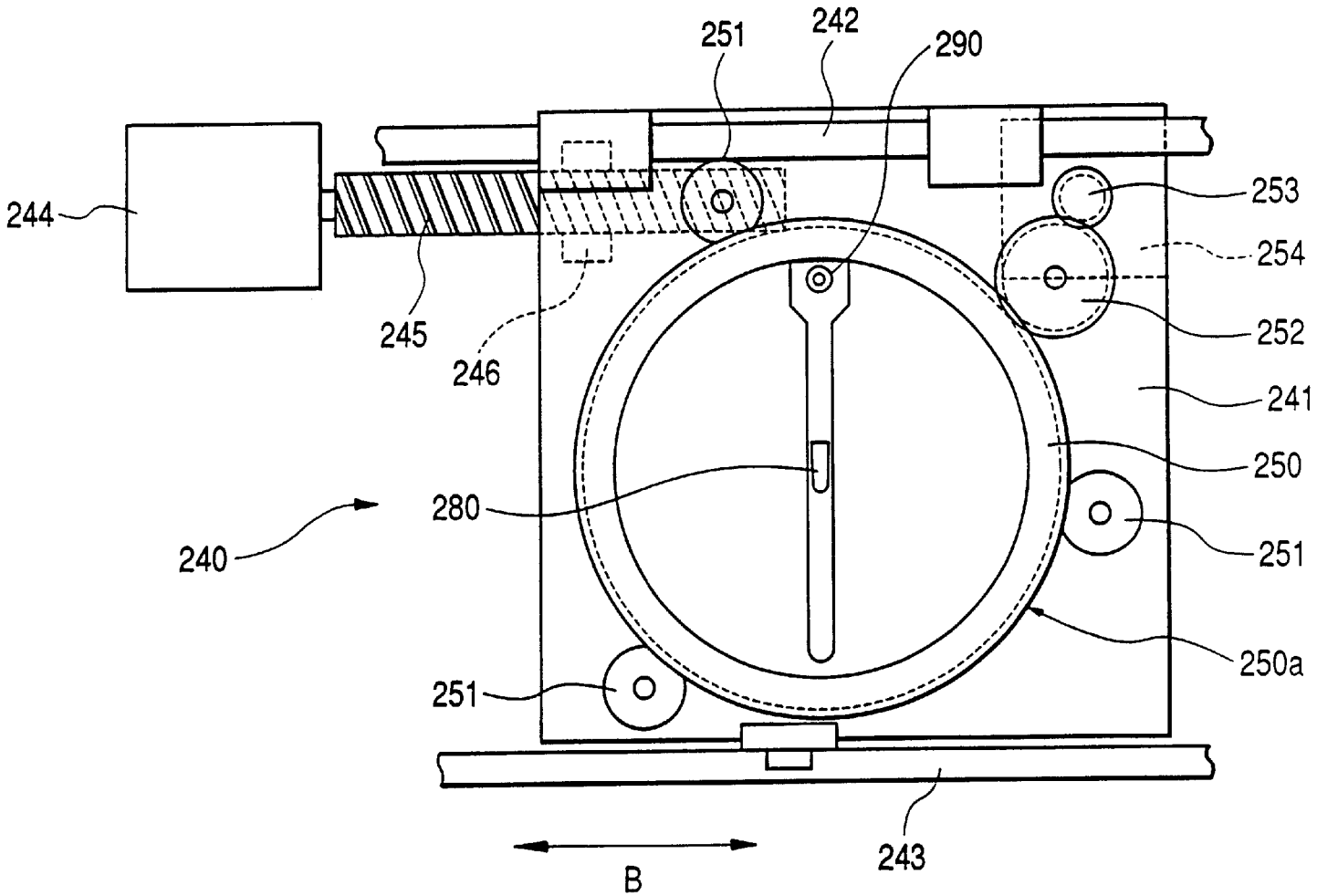
FIG. 5 is a plan view of a measuring section of the target-lens-shape measuring device.

Referring to FIGS. 5 to 8, a description will be given of the construction of the measuring section 240. FIG. 5 is a plan view of the measuring section 240. In FIG. 5, a transversely movable base 241 is supported in such a manner as to be transversely slidable along two rails 242 and 243 which are axially supported by the holding section base 201 and extend in the transverse direction (in the arrow B direction). The transverse movement of the transversely movable base 241 is effected by the driving of a motor 244 attached to the holding section base 201. A ball screw 245 is connected to a rotating shaft of the motor 244, and as the ball screw 245 meshes with an internally threaded member 246 fixed on the lower side of the transversely movable base 241, the transversely movable base 241 is moved in the transverse direction (in the arrow B direction) by the forward and reverse rotation of the motor 244.

Figure 6:
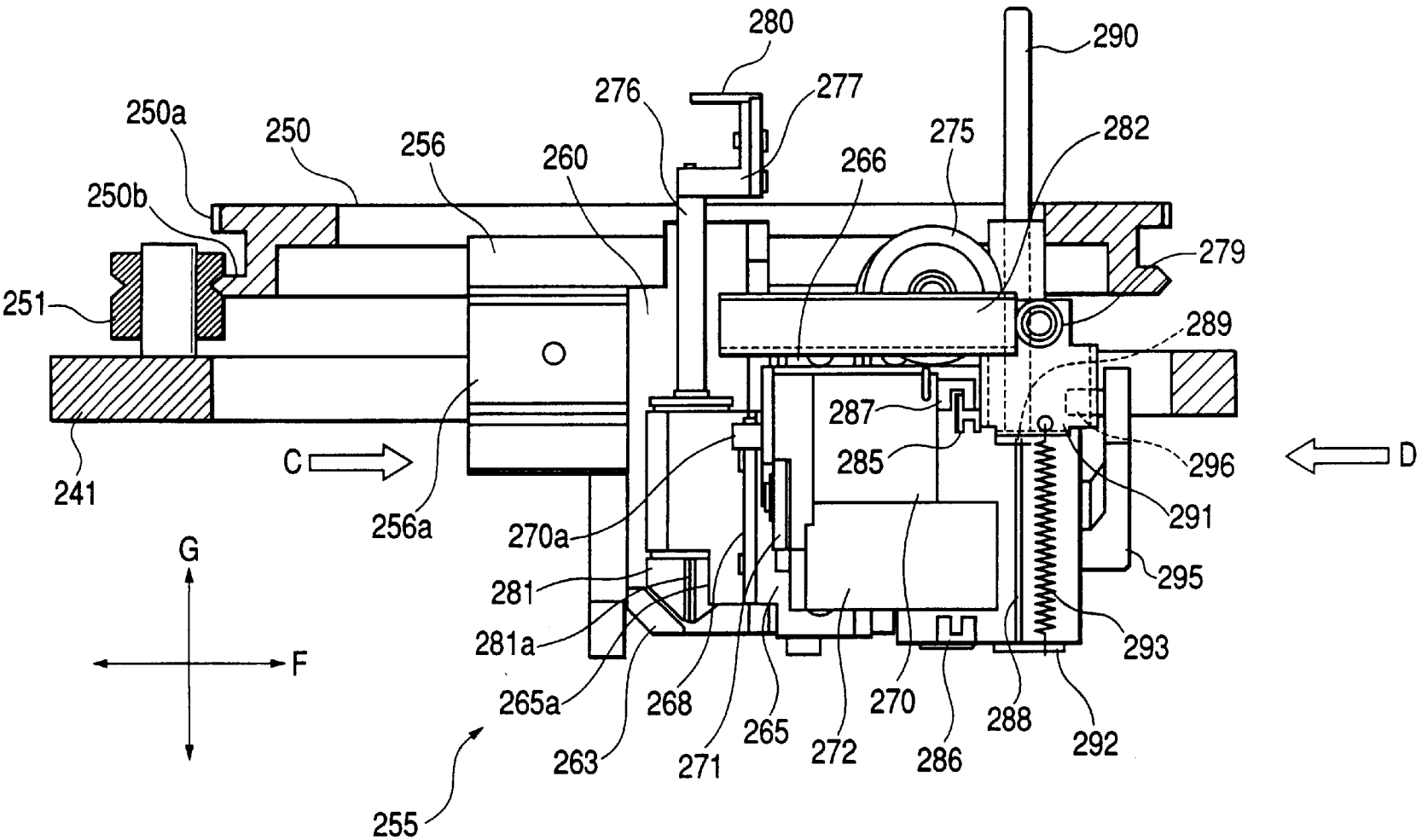
FIG. 6 is a side elevational view for explaining a feeler unit.

A rotating base 250 is rotatably held on the transversely movable base 241 by rollers 251 provided at three positions. As shown in FIG. 6, a geared portion 250*a* is formed around a circumference of the rotating base 250, and an angular or tapered guide rail 250*b* projecting in a radially outward direction is formed below the geared portion 250*a*. This guide rail 250*b* is brought into contact with a V-shaped groove of each roller 251, and the rotating base 250 rotates while being held by the three rollers 251. The geared portion 250*a* of the rotating base 250 meshes with an idle gear 252, and the idle gear 252 meshes with a gear 253 attached to a rotating shaft of a pulse motor 254 secured to the lower side of the transversely movable base 241. As a result, the rotation of the motor 254 is transmitted to the rotating base 250. A feeler unit 255 is attached to the underside of the rotating base 250.

Figure 7:
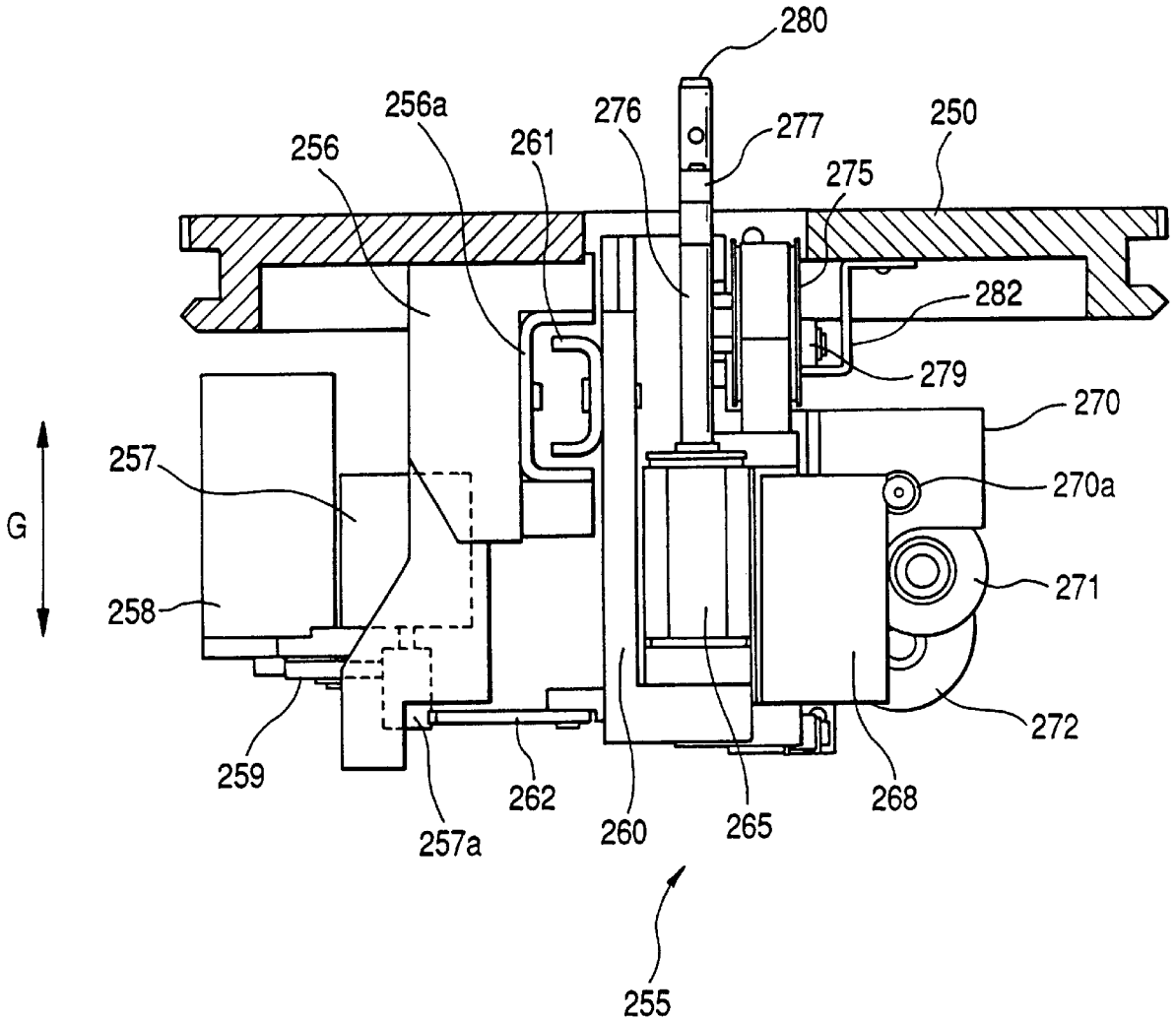
FIG. 7 is a view taken in the direction of arrow C in FIG. 6.
Figure 8:
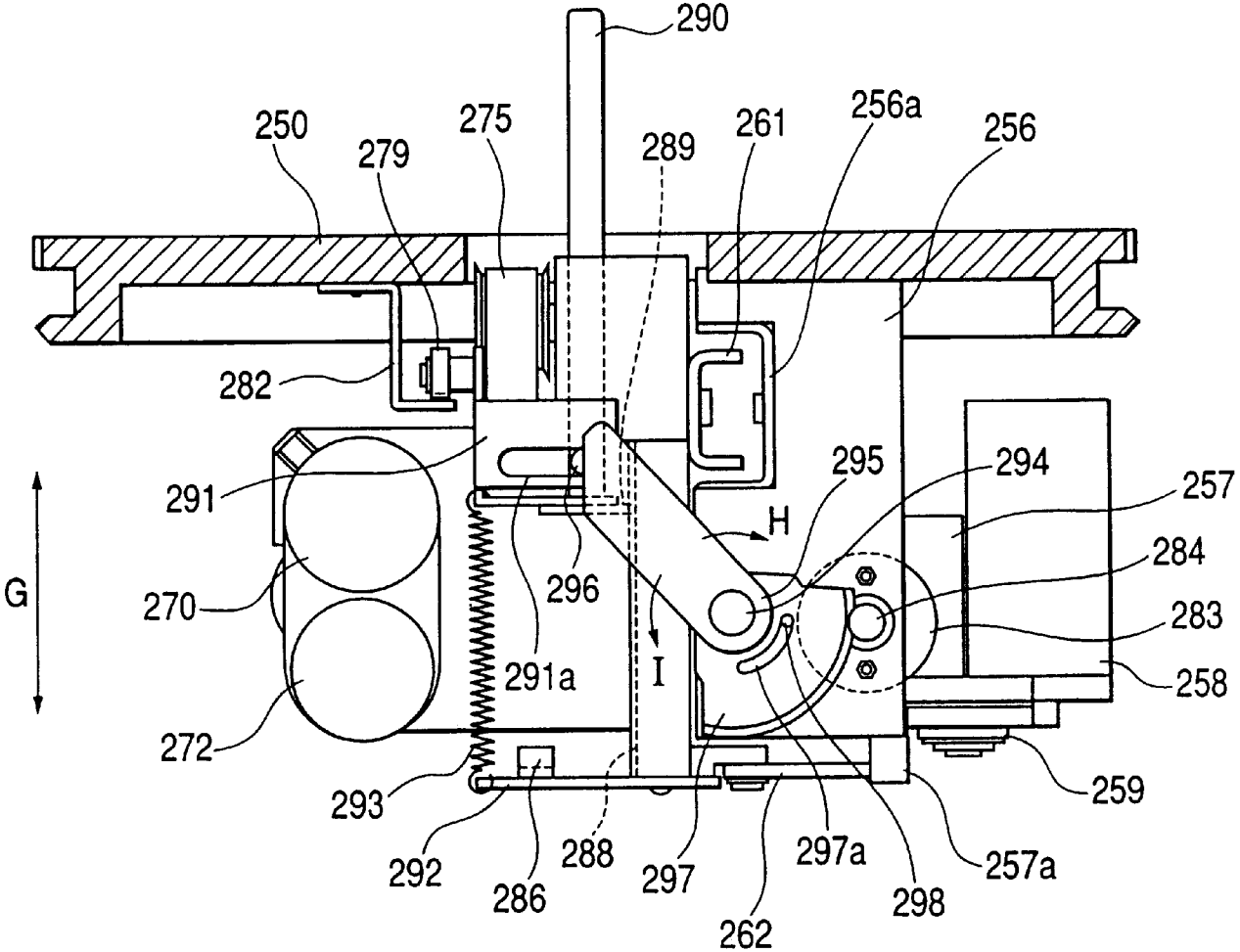
FIG. 8 is a view taken in the direction of arrow D in FIG. 6.

Referring to FIGS. 6 and 8, a description will be given of the construction of the feeler unit 255. FIG. 6 is a side elevational view for explaining the feeler unit 255, FIG. 7 is a view taken in the direction of arrow C in FIG. 6, and FIG. 8 is a view taken in the direction of arrow D in FIG. 6.

A fixed block 256 is fixed to the underside of the rotating base 250. A guide rail receiver 256*a* is attached to a side surface of the fixed block 256 in such a manner as to extend in the planar direction of the rotating base 250. A transversely movable supporting base 260 having a slide rail 261 is slidably attached to the guide rail receiver 256*a*. A DC motor 257 for moving the transversely movable supporting base 260 and an encoder 258 for detecting the amount of its movement are attached to a side of the fixed block 256 which is opposite to its side where the guide rail receiver 256*a* is attached. A gear 257*a* attached to a rotating shaft of the motor 257 meshes with a rack 262 fixed to a lower portion of the transversely movable supporting base 260, and the transversely movable supporting base 260 is moved in the left-and-right direction (in the arrow F direction) in FIG. 6 by the rotation of the motor 257. Further, the rotation of the gear 257*a* attached to the rotating shaft of the motor 257 is transmitted to the encoder 258 through an idle gear 259, and the amount of movement of the transversely movable supporting base 260 is detected from this amount of rotation.

A vertically movable supporting base 265 is supported by the transversely movable supporting base 260 to be movable in the vertical direction (in the arrow G direction). As for its moving mechanism, in the same way as the transversely movable supporting base 260, a slide rail (not shown) attached to the vertically movable supporting base 265 is slidably held on a guide rail receiver 266 attached to the transversely movable supporting base 260 and extending in the vertical direction. A vertically extending rack 268 is secured to the vertically movable supporting base 265, a gear 270*a* of a DC motor 270 attached to the transversely movable supporting base 260 by means of a fixing metal plate meshes with the rack 268, and as the motor 270 rotates, the vertically movable supporting base 265 is moved vertically. Further, the rotation of the motor 270 is transmitted through an idle gear 271 to an encoder 272 attached to the transversely movable supporting base 260 by means of a fixing metal plate, and the encoder 272 detects the amount of movement of the vertically movable supporting base 265. Incidentally, a downward load of the vertically movable supporting base 265 is reduced by a power spring 275 attached to the transversely movable supporting base 260, thereby rendering the vertical movement of the vertically movable supporting base 265 smooth.

Further, a shaft 276 is rotatably held on the vertically movable supporting base 265, an L-shaped attaching member 277 is provided at its upper end, and a feeler 280 is fixed to an upper portion of the attaching member 277. The tip of the feeler 280 is aligned with a rotational axis of the shaft 216, and the tip of the feeler 280 is to be brought into contact with a frame groove of the frame F.

A limiting member 281 is attached to a lower end of the shaft 276. This limiting member 281 has a substantially hollow cylindrical shape, and a protrusion 281*a* is formed on its side surface along the vertical direction (the arrow G direction), while another protrusion 281*a* is formed on the opposite side opposite with respect to the paper surface of FIG. 6. As these two protrusions 281*a* respectively abut against notched surfaces 265*a* (the illustrated notched surface 265*a,* and a similar notched surface 265*a* that is provided on the opposite side with respect to the paper surface of FIG. 6) formed in the vertically movable supporting base 265, the rotation of the shaft 276 (i.e., the rotation of the feeler 280) is limited to a certain range. An obliquely cut slanting surface is formed on a lower portion of the limiting member 281. When the limiting member 281 is lowered together with the shaft 276 due to the downward movement of the vertically movable supporting base 265, this slanting surface abuts against a slanting surface of a block 263 secured to the transversely movable supporting base 260. As a result, the rotation of the limiting member 281 is guided to the state shown in FIG. 6, thereby correcting the orientation of the tip of the feeler 280.

In FIG. 6, a measuring pin, i.e. a template measuring feeler, 290 is vertically slidably held on a right-hand side portion of the transversely movable supporting base 260. Here, if consideration is given to a mechanism for vertically moving the measuring pin 290, a mechanism is conceivable in which a motor is attached to the transversely movable supporting base 260, and the measuring pin 290 is vertically moved by such as a mechanism including a rack and a pinion. However, since the arrangement in which the motor, the rack, the pinion, and the like are merely attached to the transversely movable supporting base 260 adds weight of these components, an inertial force becomes large when the transversely movable supporting base 260 is moved. Consequently, the measurement accuracy becomes poor, and speedily measurement becomes impossible. Accordingly, the apparatus of the invention is so arranged that the motor for vertically moving the measuring pin 290 is not mounted on the transversely movable supporting base 260. Hereafter, a description will be given of the mechanism for vertically moving the measuring pin 290.

In FIG. 6, a pin moving supporting base 291 is attached to a lower end of the measuring pin 290 which is vertically slidably held on the transversely movable supporting base 260. A plate 292 extending in a direction perpendicular to the plane of the drawing of FIG. 6 is attached to a lower end of the transversely movable supporting base 260. A spring 293 is stretched between this plate 292 and a lower portion of the pin moving supporting base 291, so that the measuring pin 290 is constantly urged in the downward direction.

In addition, a guide groove 288 is formed in the transversely movable supporting base 260 in the vertical direction (in the arrow G direction), and a pin 289 attached to the pin moving supporting base 291 is fitted in the guide groove 288 and serves for preventing relative rotation between the pin moving supporting base 291 and the measuring pin 290.

As shown in FIG. 8, a slot 291*a* is formed in the pin moving supporting base 291, and a pin 296 attached to an arm 295 which rotates about a shaft 294 is engaged with the slot 291*a*. A gear 297 is fixed to the arm 295, and this gear 297 meshes with a gear 284 attached to a rotating shaft of a DC motor 283 attached to the fixed block 256. As a result, the rotation of the motor 283 is transmitted to the gear 284, and as the arm 295 rotates, the pin moving supporting base 291 is vertically moved. A fan-shaped slot 297*a* is formed in the gear 297. A pin 298 attached to the fixed block 256 is inserted in the slot 297*a* so as to limit the angle of rotation of the gear 297.

In addition, photosensors 286 and 287 are attached to the transversely movable supporting base 260 on upper and lower sides thereof, respectively, and as a light shielding plate 285 enters the photosensor 286 or 287, it can be detected whether the measuring pin 290 is at the measuring position (at the position where the measuring pin 290 is at the most elevated position) or at the retreated position (at the most lowered position). In addition, only the photosensor 287 may be used so as to only detect whether or not the measuring pin 290 is at the measuring position.

A roller 279 is attached to the pin moving supporting base 291. When the transversely movable supporting base 260 is moved leftward (in the direction of arrow D) from the state shown in FIG. 6, the roller 279, while being subjected to a downwardly urging force by the spring 293, rolls on a guide 282 attached to the rotating base 250. Consequently, the measurement of the template is effected in a state in which the measuring pin 290 is at the measuring position, and is separated from the vertically moving mechanism including the motor 283, the arm 295, and the like.

<Template Holder>

Figure 9:
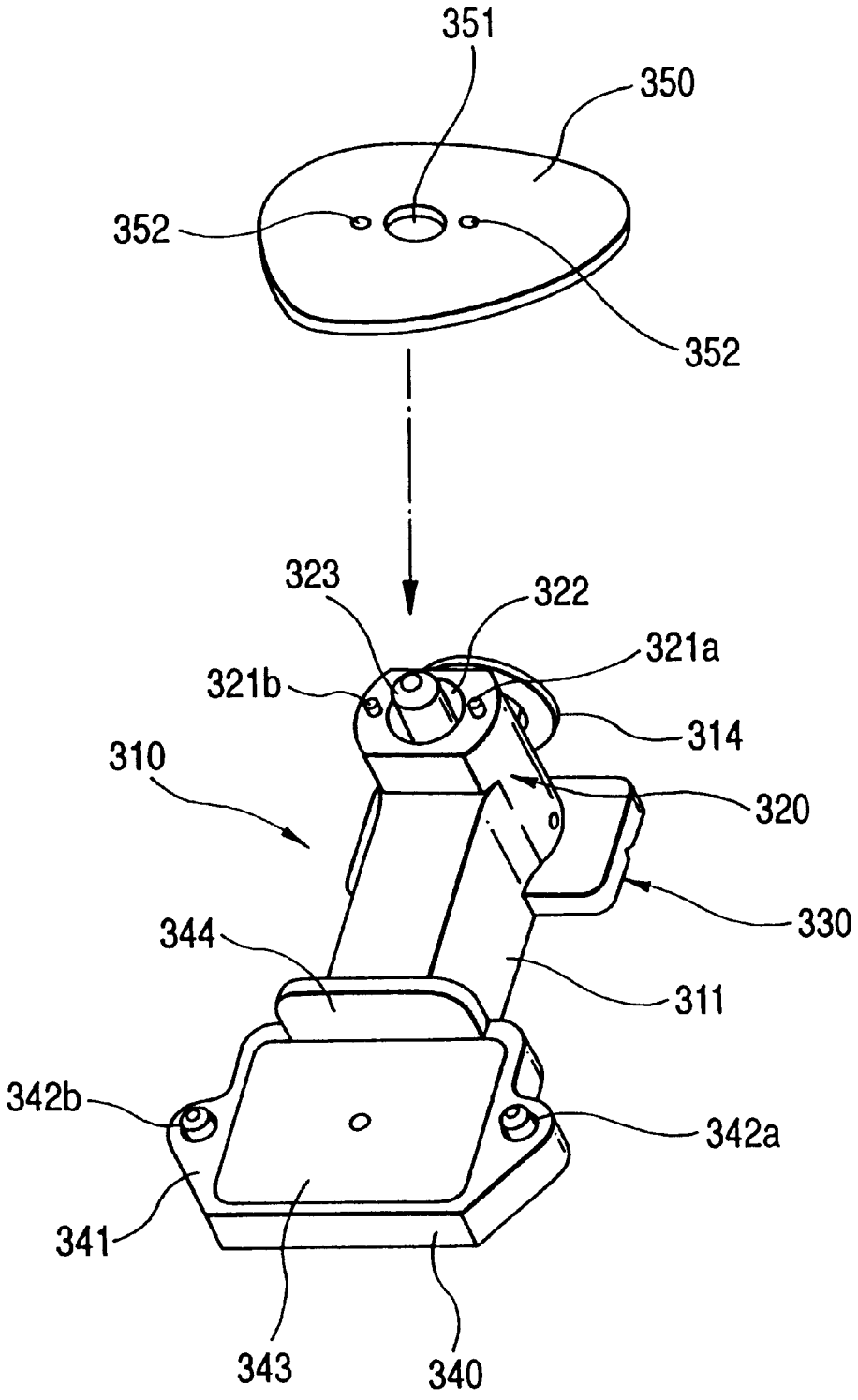
FIG. 9 is a perspective view of a template holder in a state in which a template holding portion for mounting a template thereon is oriented upward.
Figure 10:
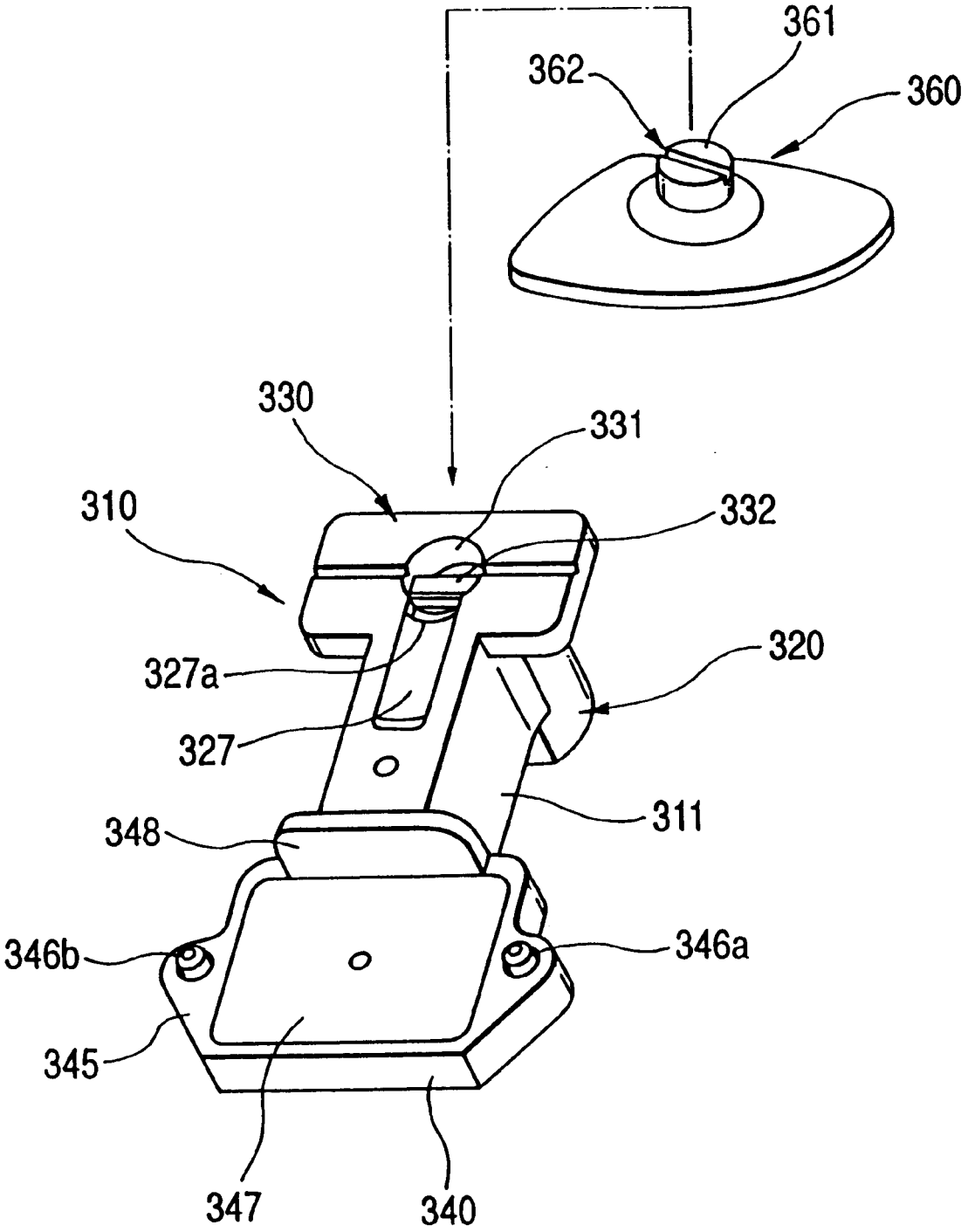
FIG. 10 is a perspective view of the template holder in a state in which a cup holding portion for mounting a dummy lens thereon is oriented upward.
Figure 11:
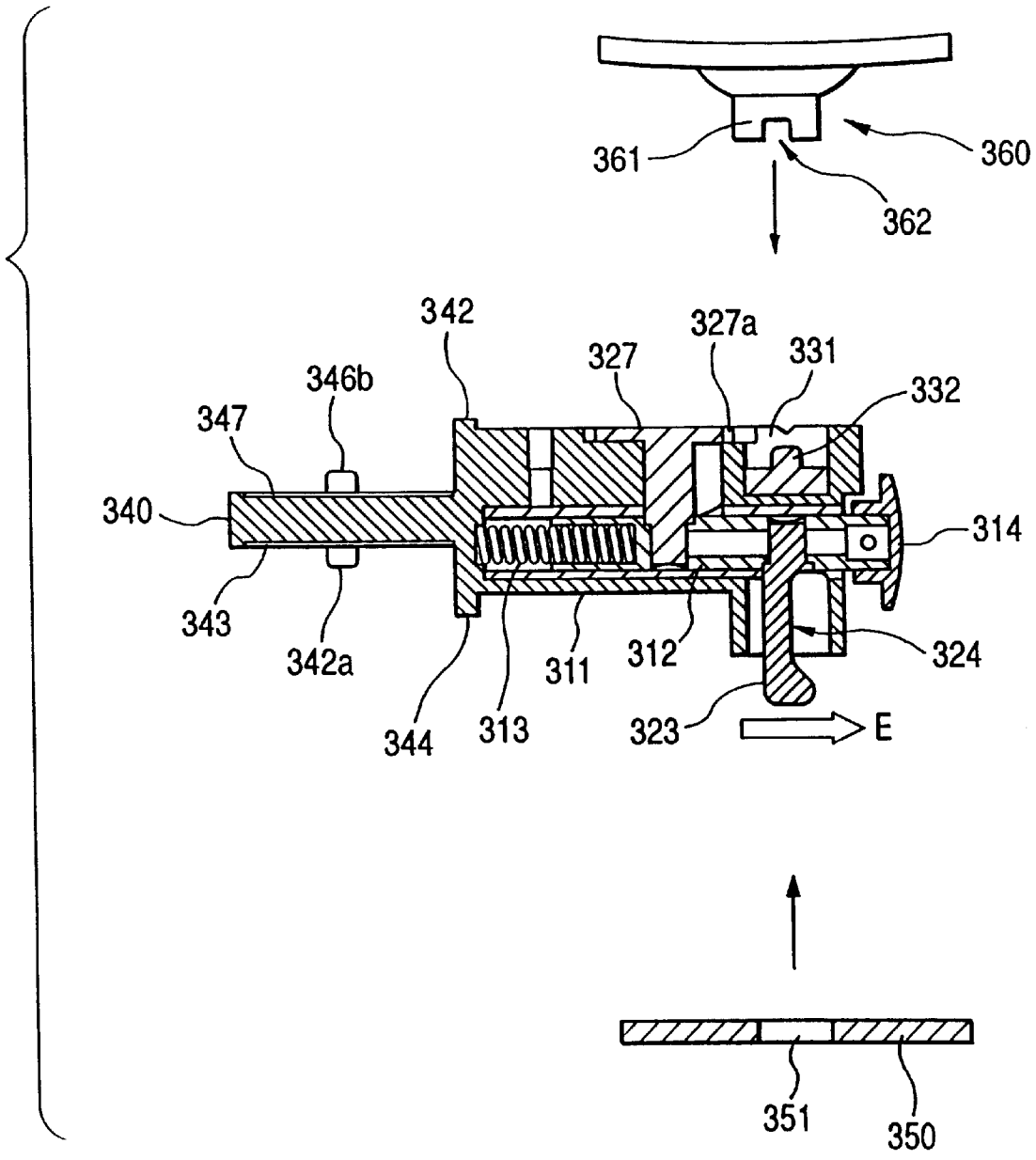
FIG. 11 is a longitudinal cross-sectional view of the template holder.

Referring to FIGS. 9 to 11, a description will be given of the construction of the template holder 310. FIG. 9 is a perspective view of the template holder 310 in a state in which a template holding portion 320 for mounting a template 350 thereon is oriented upward. FIG. 10 is a perspective view of the template holder 310 in a state in which a cup holding portion 330 for mounting a dummy lens thereon is oriented upward. FIG. 11 is a longitudinal cross-sectional view of the template holder 310.

The template holding portion 320 and the cup holding portion 330 are provided integrally on opposite surfaces, respectively, of a main body block 311 of the template holder 310 so that the template holding portion 320 and the cup holding portion 330 can be selectively used by inverting the template holder 310. Pins 321*a* and 321*b* are implanted on the template holding portion 320, an opening 322 is provided in the center, and a movable pin 323 projects from the opening 322. As shown in FIG. 11, the movable pin 323 is fixed to a movable shaft 312 inserted in the main body block 311, and the movable shaft 312 is constantly urged in the direction of arrow E in FIG. 11 by a spring 313. A button 314 for performing a pushing operating is attached to a distal end of the movable shaft 312 projecting from the main body block 311. Further, a recessed portion 324 is formed on the front side (right-hand side in FIG. 11) of the movable pin 323.

A hole 331 for inserting a basal part 361 of a cup 360 with a dummy lens fixed thereon is formed in the cup holding portion 330, and a projection 332 for fitting to a key groove 362 formed in the basal part 361 is formed inside the hole 331. Further, a sliding member 327 is fixed to the movable shaft 312 inserted in the main body block 311, and its front-side end face 327*a* is circular-arc shaped (a circular arc of the same diameter as that of the hole 331).

At the time of fixing the template 350, after the button 314 is manually pushed in, the template 350 is positioned such that a central hole 351 is fitted over the movable pin 323 while two small holes 352 provided on both sides of the central hole 351 are engaged with the pins 321*a* and 321*b*. Subsequently, if the button 314 pushed in toward the main body block 311 side is released, the movable pin 323 is returned in the direction of arrow E by the urging force of the spring 313, and its recessed portion 324 abuts against the wall of the central hole 351 in the template 350, thereby fixing the template 350.

At the time of fixing the cup 360 attached to the dummy lens, in the same way as with the template, after the button 314 is manually pushed in to open the sliding member 327, the key groove 362 of the basal part 361 is fitted to the projection 332. Upon releasing the button 314, the sliding member 327 together with the movable shaft 312 is returned toward the hole 331 by the urging force of the spring 313. As the basal part 361 of the cup 360 inserted in the hole 331 is pressed by the circular-arc shaped end face 327*a,* the cup 360 is fixed in the cup holding portion 330.

A fitting portion 340 for fitting the template holder 310 to the attaching plate 300 of the holding section base 201 is provided on the rear side of the main body block 311, and its obverse side (the template holding portion 320 side is assumed to be the obverse side) has the same configuration as the reverse side. Pins 342*a,* 342*b* and 346*a,* 346*b* for insertion into the two holes 302 formed in the upper surface of the attaching plate 300 are respectively implanted on the obverse surface 341 and the reverse surface 345 of the fitting portion 340. Further, iron plates 343 and 347 are respectively embedded in the obverse surface 341 and the reverse surface 345. Flanges 344 and 342 are respectively formed on the obverse surface 341 and the reverse surface 345 of the fitting portion 340.

At the time of attaching the template holder 310 to the target-lens-shape measuring device 2, after the front slider 202 is opened toward the front side (the rear slider 203 is also opened simultaneously), in the case of the template measurement, the template holding portion 320 side is oriented downward, and the pins 342*a* and 342*b* on the fitting portion 340 are engaged in the holes 302 in the attaching plate 300. At this time, since the iron plate 343 is attracted by the magnet 301 provided on the upper surface of the attaching plate 300, the template holder 310 can be easily fixed immovably to the upper surface of the attaching plate 300. Further, the flange 344 of the template holder 310 abuts against a recessed surface 202*a* formed in the center of the front slider 202 to maintain the open state of the front slider 202 and the rear slider 203.

(B) Carriage Section

Referring to FIG. 2, a description will be given of the construction of the carriage section 700. The carriage 701 is capable of rotating the lens LE while chucking it with two lens chuck shafts (lens rotating shafts) 702L and 702R, and is rotatably slidable with respect to a carriage shaft 703 that is fixed to the base 10 and that extends in parallel to the abrasive-wheel rotating shaft 601. Hereafter, a description will be given of a lens chuck mechanism and a lens rotating mechanism as well as an X-axis moving mechanism and a Y-axis moving mechanism of the carriage 701 by assuming that the direction in which the carriage 701 is moved in parallel to the abrasive-wheel rotating shaft 601 is the X axis, and the direction for changing the axis-to-axis distance between the chuck shafts (702L, 702R) and the abrasive-wheel rotating shaft 601 by the rotation of the carriage 701 is the Y axis.

<Lens Chuck Mechanism and Lens Rotating Mechanism>

The chuck shaft 702L and the chuck shaft 702R are rotatably held coaxially by a left arm 701L and a right arm 701R, respectively, of the carriage 701. A chucking motor 710 is fixed to the center of the upper surface of the right arm 701R of the carriage 701. Using the rotation of the motor 701 as power source, the chuck shaft 702R can be moved in the axial direction, so that the lens LE is clamped by the chuck shafts 702L and 702R.

A rotatable block 720 for attaching a motor, which is rotatable about the axis of the chuck shaft 702L, is attached to a left-side end portion of the carriage 701, and the chuck shaft 702L is passed through the block 720, a gear 721 being secured to the left end of the chuck shaft 702L. A motor 722 for lens rotation is fixed to the block 720, and as the motor 722 rotates the gear 721 through a gear 724, the rotation of the motor 720 is transmitted to the chuck shaft 702L.

<X-axis Moving Mechanism and Y-axis Moving Mechanism of Carriage>

The carriage shaft 703 is provided with a movable arm 740 which is slidable in its axial direction so that the arm 740 is movable in the X-axis direction (in the axial direction of the shaft 703) together with the carriage 701. Further, the arm 740 at its front position is slidable on and along a guide shaft 741 that is secured to the base 10 in a parallel positional relation to the shaft 703. A rack 743 extending in parallel to the shaft 703 is attached to a rear portion of the arm 740, and this rack 743 meshes with a pinion 746 attached to a rotating shaft of a motor 745 for moving the carriage in the X-axis direction, the motor 745 being secured to the base 10. By virtue of the above-described arrangement, the motor 745 is able to move the carriage 701 together with the arm 740 in the axial direction of the shaft 703 (in the X-axis direction).

A swingable block 750 is attached to the arm 740 in such a manner as to be rotatable about the axis which is in alignment with the rotational center of the abrasive wheels 602. A Y-axis moving motor 751 is attached to the swingable block 750, and the rotation of the motor 751 is transmitted through a belt 753 to a female screw 755 held rotatably in the swingable block 750. A feed screw 756 is inserted in a threaded portion of the female screw 755 in mesh therewith, and the feed screw 756 is moved vertically by the rotation of the female screw 755.

A guide block 760 which abuts against a lower end surface of the motor-attaching block 720 is fixed to an upper end of the feed screw 756, and the guide block 760 moves along two guide shafts 758 implanted on the swingable block 750. Accordingly, as the guide block 760 is vertically moved together with the feed screw 756 by the rotation of the motor 751, it is possible to change the vertical position of the block 720 abutting against the guide block 760. As a result, the vertical position of the carriage 701 attached to the block 720 can be also changed (namely, the carriage 701 rotates about the shaft 703 to change the axis-to-axis distance between the chuck shafts (702L, 702R) and the abrasive-wheel rotating shaft 601).

Figure 12:
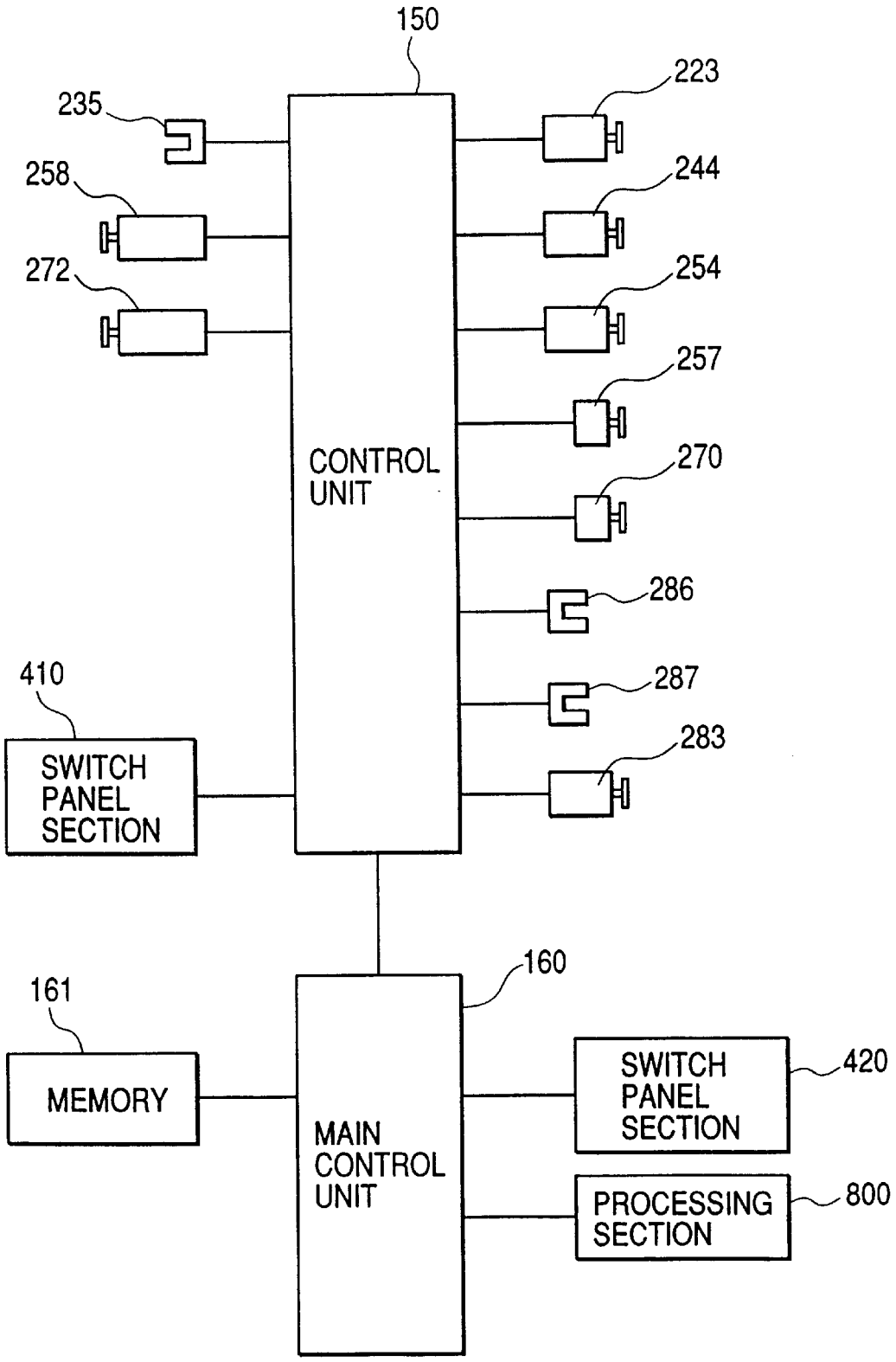
FIG. 12 is a control system block diagram of the apparatus.

Next, referring to the control system block diagram of FIG. 12, a description will be given of the operation of the apparatus having the above-described construction.

When the template 350 is measured by the target-lens-shape measuring device 2, the front slider 202 is pulled toward the front side, and the template holder 310 with the template 350 fixed thereto is attached to the upper surface of the attaching plate 300. Since the flange 344 of the template holder 310 is engaged with the recessed surface 202*a* of the front slider 202, the opening of the front slider 202 and the rear slider 203 is fixed. The open state of the front slider 202 is detected by a sensor plate 236 and a sensor 235, so that the template measurement mode is detected.

After the setting of the template holder 310, in a case where the template 350 to be measured is for the right use, a right trace switch 413 on the switch panel section 410 is pressed, whereas in a case where the template 350 is for the left use, a left trace switch 411 is pressed. In the case of both-eye trace the switch 412 is pressed.

A control unit 150 drives the motor 244 to position the measuring section 240 (the transversely movable supporting base 241) at the measuring position in the center. The initial position of the transversely movable supporting base 260 in the template measurement mode is set at the position where the transversely movable supporting base 260 abuts against an inner end face of the rotating base 250, i.e., at the outermost position in the movable range of the transversely movable supporting base 260. Accordingly, as shown in FIG. 6, the pin 296 attached to the arm 295 is engaged with the slot 291*a* formed in the pin moving supporting base 291, and the measuring pin 290 and the vertically moving mechanism including the motor 283 and the like are in a linked state.

When the control unit 150, upon receiving a tracing start signal, drives the motor 283, the gear 297 in mesh with the gear 284 attached to the shaft of the motor 283 rotates, which in turn causes the arm 295 secured coaxially to the gear 297 through the shaft 294 to rotate in the direction of arrow H. As the arm 295 rotates in the direction of arrow H, the pin moving supporting base 291 is raised, so that the measuring pin 290 secured to the pin moving supporting base 291 is also raised. When the pin moving supporting base 291 has been raised most, the light shielding plate 285 attached to the pin moving supporting base 291 enters the photosensor 287, so that the photosensor 287 detects that the measuring pin 290 has risen to the measuring position. Upon receiving this detection signal, the control unit 150 drives the motor 257 so as to allow the measuring pin 290 to be oriented toward the center (in the direction of arrow D) and move the transversely movable supporting base 260. Consequently, the pin moving supporting base 291 (the slot 291*a*) is disengaged from the pin 296 attached to the arm 295, the roller 279 rolls on the guide 282, and the measuring pin 290 remains raised at the top (at the measuring position).

Accordingly, the measurement of the template 350 is effected in the state in which the measuring pin 290 is separated from the vertically moving mechanism including the motor 283 and the like, and the measuring pin 290 is placed at the measuring position. During the movement of the transversely movable supporting base 260, the driving current to the motor 257 is controlled to provide a predetermined driving torque. In a state in which the measuring pin 290 abuts against the end face of the template 350, the pulse motor 254 is rotated in accordance with each predetermined unit number of rotational pulses to rotate the feeler unit 255. As a result of this rotation, the transversely movable supporting base 260 together with the measuring pin 290 slides in the leftward and rightward direction (in the direction of arrow F) in accordance with the radius vector of the template 350, and the amount of its movement is detected by the encoder 258, thereby measuring the target lens shape. Since the motor 283 large in weight is not mounted on the transversely movable supporting base 260, the movement of the transversely movable supporting base 260 takes place smoothly, and the follow-up movement of the measuring pin 290 in accordance with the radius vector of the template 350 is not degraded. Accordingly, the measurement data can be obtained with high accuracy.

Upon completion of the measurement of the entire periphery of the template 350, the transversely movable supporting base 260 is moved to its initial position under control by the control unit 150. In this position, the roller 279 is disengaged from the guide 282, and the pin 296 attached to the arm 295 comes into engagement with the slot 291*a* of the pin moving supporting base 291. In addition, the arm 295 separated from the pin moving supporting base 291 during the target lens shape measurement, after the arm 295 may be lowered, and thereafter the power supply to the motor 283 may be cut off. The arm 295 may be raised again by rotating the motor 283 in response to the signal representing the completion of the measurement.

After the pin 296 is engaged with the slot 291*a,* the pin moving supporting base 291 and the measuring pin 290 are moved downward by the slight rotation of the arm 295 in the direction of arrow I with the motor 283 and by the urging force of the spring 293. At the point of time when the pin moving supporting base 291 has been lowered, the light shielding plate 285 attached to the pin moving supporting base 291 enters the photosensor 286, thereby detecting the fact that the measuring pin 290 has been lowered to the lower position (retreated position).

Figure 14:
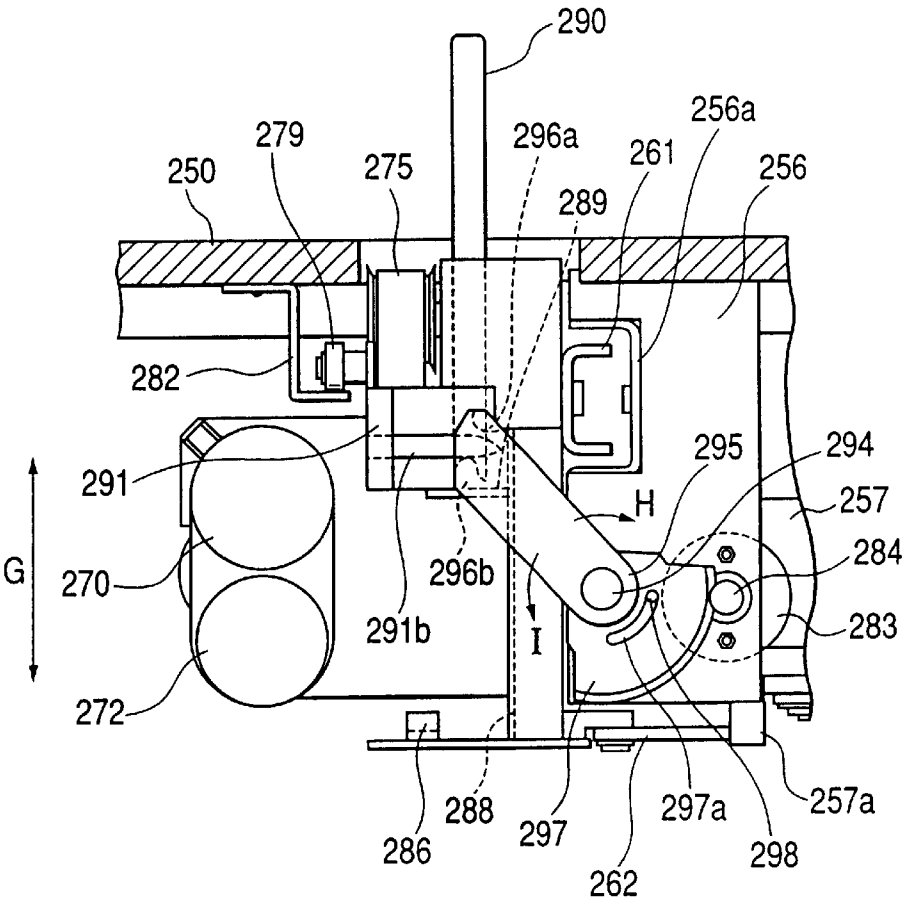
FIG. 14 is a view taken in the direction of arrow D in FIG. 13.
Figure 13:
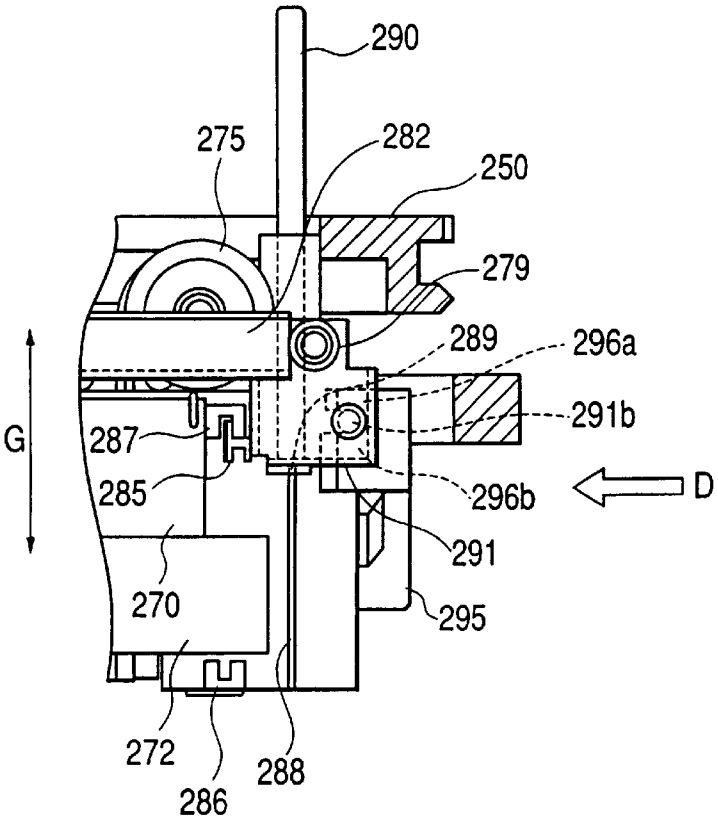
FIG. 13 is a side elevational view for explaining a modification of the feeler unit.

Next, a description will be given of a modification of the feeler unit 255. FIG. 13 is a side elevational view for explaining the modification of the feeler unit 255, and FIG. 14 is a view taken in the direction of arrow D in FIG. 13.

The construction shown in FIG. 13 differs from the construction shown in FIG. 6 in that the plate 292 and the spring 293 are omitted, and a downward force acts on the pin moving supporting base 291 due to its own weight. The construction shown in FIG. 14 differs from the construction shown in FIG. 8 in that a pin 291*b* is provided on the pin moving supporting base 291 instead of the slot 291*a,* and the arm 295 is provided with pins 296*a* and 296*b* on its upper and lower sides, respectively, so that the pin 291*b* is interposed between the pins 296*a* and 296*b.*

As shown in FIG. 13, in the initial position of the transversely movable supporting base 260 in the template measurement mode, the pin 291*b* provided on the pin moving supporting base 291 is located between the pins 296*a* and 296*b* provided on the arm 295, and the measuring pin 290 and the vertically moving mechanism including the motor 283 and the like are in a linked state.

When the control unit 150, upon receiving a tracing start signal, rotates the motor 283, the gear 297 is rotated, which, in turn, rotates the arm 295 in the direction of arrow H. The rotation of the arm 295 in the direction of arrow H causes the pin moving supporting base 291 to be moved upward, so that the measuring pin 290 secured to the pin moving supporting base 291 is also moved upward. Upon receiving a detection signal from the photosensor 287, the control unit 150 drives the motor 257 to move the transversely movable supporting base 260 so that the measuring pin 290 is oriented toward the center (in the direction of arrow D). Consequently, the pin 291*b* is disengaged from a space between the pins 296*a* and 296*b,* the roller 279 rolls on the guide 282, and the measuring pin 290 remains raised at the top (at the measuring position). Accordingly, the measurement of the template 350 is effected in the state in which the measuring pin 290 is separated from the vertically moving mechanism including the motor 283 and the like, and in the state in which the measuring pin 290 is placed at the measuring position.

Upon completion of the measurement of the entire periphery of the template 350, the transversely movable supporting base 260 is moved to its initial position under control by the control unit 150. In this position, the roller 279 is disengaged from the guide 282, and the pin 291*b* enters the space between the pins 296*a* and 296*b.* After the pin 291*b* entered the space between the pins 296*a* and 296*b,* the pin moving supporting base 291 and the measuring pin 290 are moved downward by the slight rotation of the arm 295 in the direction of arrow I with the motor 283 and by the self-weight of the pin moving supporting base 291, thereby positioning the pin 290 at the retreated position.

Next, a brief description will be given of the case where the eyeglass frame is measured. After the frame is set on the frame holding section 200, the switch on the switch panel section 410 is pressed to start tracing. In the case of both-eye tracing, the control unit 150 drives the motor 244 to move the transversely movable base 241 so that the feeler 280 is located at a predetermined position on the right frame side of the eyeglass frame. Subsequently, the vertically movable supporting base 265 is raised by driving the motor 270 to position the feeler 280 at the height of the reference plane for measurement.

Subsequently, the control unit 150 drives the motor 257 to move the transversely movable supporting base 260 so that the tip of the feeler 280 is inserted into the frame groove of the frame. During this movement, since a DC motor is used as the motor 257, the driving current (driving torque) to the motor 257 can be controlled to provide a predetermined driving torque. Therefore, it is possible to impart a weak pressing force of such a degree that the frame in not deformed and that the feeler 280 is not dislocated. Subsequently, the pulse motor 254 is rotated in accordance with each predetermined unit number of rotational pulses to rotate the feeler unit 255 together with the rotating base 250. As a result of this rotation, the transversely movable supporting base 260 together with the feeler 280 moves along the direction of the rail of the guide rail receiver 256*a* (in the direction of arrow F) in accordance with the radius vector of the frame groove, and the amount of its movement is detected by the encoder 258. Further, the vertically movable supporting base 265 together with the feeler 280 moves in accordance with the warp (curve) of the frame groove vertically along the direction of the rail of the guide rail receiver 266 (in the direction of arrow G), and the amount of its movement is detected by the encoder 272. The lens frame shape is measured from the angle of rotation θ of the pulse motor 254, the amount r detected by the encoder 258, and the amount z detected by the encoder 272.

During the measurement the eyeglass frame as well, since the weight of the motor 283 for vertically moving the measuring pin 290 is not applied to the transversely movable supporting base 260, the inertial force at the time of movement does not become large. Therefore, the tip of the feeler 280 moves along the frame groove without being dislocated from the frame groove, and the target lens shape of the lens frame is measured with high accuracy.

Upon completion of the measurement of the target lens shape in the above-described manner, the operator presses a data switch 421 on the switch panel section 420, so that the target lens shape data is transferred to a data memory 161, and the target lens shape is graphically displayed on the display 415. By operating switches for data input arranged on the switch panel section 420, the operator enters layout data such as the PD value of the wearer, the frame PD, and positional data on the optical center height. Further, the operator enters data on the processing conditions such as the material of the frame, lens material, and the like. Subsequently, the operator allows the lens LE to be chucked by the chuck shafts 702L and 702R to perform processing.

When a start signal is inputted by a start switch 423, a main control unit 160 of the lens processing apparatus executes the lens shape measurement by using the lens-shape measuring section 500 in accordance with a processing sequence program. Subsequently, on the basis of the processing data obtained in accordance with the inputted data, the driving of the respective motors of the lens processing section 800 is controlled to move the carriage 701 transversely (in the X direction) and vertically (in the Y direction), and bring the lens LE into pressure contact with a rotating abrasive wheel of a group of abrasive wheels 602 for processing.

As described above, in accordance with the invention, in the measurement of the shape of the template or the dummy lens, the troublesome attachment and detachment of the measuring pin can be eliminated, and high-accuracy measurement can be effected. In addition, in the measurement of the eyeglass frame as well, the feeler is prevented from being dislocated from the frame groove, and the measurement accuracy is not impaired.

What is claimed is:

1. A target lens shape measuring device for measuring a target lens shape of an eyeglass lens, comprising:

first fixing means for fixing an eyeglass frame at a first predetermined position;

second fixing means for fixing a template at a second predetermined position;

a frame measuring unit held by a rotating base, the frame measuring unit including a first moving base that is movable in a radius vector direction of a lens frame of the fixed eyeglass frame, a second moving base that is held by the first moving base and is movable in a vertical direction, and a frame feeler that is attached to the second moving base and is contactable with a frame groove of the lens frame; and a template measuring unit including a third moving base that is held by the first moving base and is movable in the vertical direction, a template feeler that is attached to the third moving base and is connectable with a periphery of the fixed template, a motor that is disposed fixedly on the rotating base, and a transmitting mechanism that transmits driving power of the motor to move the third moving base, wherein the third moving base is disconnected from the transmitting mechanism and is retained at a height of the measuring position when the template feeler moves upward and reaches the measuring position.

2. The device according to claim 1, wherein the template measuring unit further includes a sensor that detects a state in which the template feeler and the third moving base are located at the measuring position.

3. The device according to claim 2, further comprising a control section that controls operation of the template measuring unit based on a result of detection by the sensor to measure the template.

4. An eyeglass lens processing apparatus, provided with the target lens shape measuring device of claim 1, for processing the eyeglass lens based on the obtained target lens shape, the apparatus comprising:

a lens processing section having a processing tool and a lens rotating shaft adapted to hold and rotate the lens; and a processing control section that controls the lens processing section based on the obtained target lens shape.

* * * * *